US006506113B2

(12) United States Patent
Berger

(10) Patent No.: US 6,506,113 B2
(45) Date of Patent: Jan. 14, 2003

(54) MODULAR AIR VENT ASSEMBLY KIT

(75) Inventor: Brian K. Berger, Eureka, MO (US)

(73) Assignee: Innovative Vent Solutions, Inc., Pacific, MO (US)

( * ) Notice: Subject to any disclaimer, the term of this patent is extended or adjusted under 35 U.S.C. 154(b) by 0 days.

(21) Appl. No.: 09/919,292

(22) Filed: Jul. 31, 2001

(65) Prior Publication Data

US 2002/0022450 A1 Feb. 21, 2002

Related U.S. Application Data

(63) Continuation-in-part of application No. 09/638,817, filed on Aug. 14, 2000, now Pat. No. 6,302,784.

(51) Int. Cl.[7] ..... F24F 7/00
(52) U.S. Cl. ..... 454/290; 454/309
(58) Field of Search ..... 454/290, 289, 454/318, 325, 309, 335, 331, 332, 271, 273; 55/491, 493, 511

(56) References Cited

U.S. PATENT DOCUMENTS 4,334,899 A * 6/1982 McConnell ..... 454/309
5,163,871 A * 11/1992 Huibregtse et al. ..... 454/289
5,597,392 A * 1/1997 Hawkins et al. ..... 422/123
5,792,230 A * 8/1998 Moore et al. ..... 454/290
5,938,525 A * 8/1999 Birdsong et al. ..... 454/290
6,033,304 A * 3/2000 Haynes ..... 455/290

* cited by examiner

*Primary Examiner*—Derek Boles
(74) *Attorney, Agent, or Firm*—Thompson Coburn LLP

(57) ABSTRACT

A modular air vent assembly kit can be used to cover duct openings that supply a flow of heated or cooled air to a room in addition to covering duct openings that receive return air from a room. The modular air vent assembly kit is comprised of a frame, a base, a damper mechanism, and two different face plates where the damper mechanism can be selectively assembled into the base depending on whether control through the air vent by operation of a damper is needed in the particular duct opening and where either of the two face plates may be selectively connected with the base where one face plate has a lattice and is used in combination with the damping mechanism and the other face plate has a series of louvers and is used when the damping mechanism is not used in the vent assembly. The frame is secured to an air duct opening and the base and attached face plate are removably attachable to the frame without the need for separate fasteners.

19 Claims, 10 Drawing Sheets

MODULAR AIR VENT ASSEMBLY KIT

This is a Continuation-In-Part Patent Application of patent application Ser. No. 09/638,817, filed Aug. 14, 2000 and now U.S. Pat. No. 6,302,784.

BACKGROUND OF THE INVENTION (1) Field of the Invention

The present invention pertains to a modular air vent assembly kit that can be used to cover duct openings that supply a flow of heated or cooled air to a room in addition to covering duct openings that receive return air from a room. In particular, the modular air vent assembly kit of the invention is comprised of a base, a damper mechanism, and two different faceplates where the damper mechanism can be selectively assembled into the base depending on whether control through the air vent by operation of a damper is needed in the particular duct opening and where either of the two faceplates may be selectively connected with the base where one faceplate has a lattice and is used in combination with the damping mechanism and the other faceplate has a series of louvers and is used when the damping mechanism is not used in the vent assembly. In a further embodiment of the modular air vent assembly kit, the kit includes a frame that can be secured to an air duct opening using conventional fasteners. The frame is constructed to receive the base of the kit in an internal volume of the frame and attach to the base without the requirement of separate fasteners. With the kit including the frame, the frame can first be secured to an air duct opening and then the base can be assembled with or without a damper mechanism and air filter and can then be secured in the frame without the use of separate fasteners. The face plate can then be secured to the base with the border of the face plate overlying the attachment of the frame to the air duct opening obstructing the attachment from view and giving the assembled modular air vent assembly a more aesthetic appearance.

(2) Description of the Related Art

In many HVAC systems, and in particular in HVAC systems used in households, the network of air ducts that make up the system communicate with two groups of outlets or openings, one group providing an outlet for cooled or heated air and the other group providing an inlet for return air to the HVAC system. These two different groups of openings are usually covered by two different types of air vent assemblies.

Air vent assemblies that cover return air openings or inlets of HVAC systems are commonly constructed as rectangular panels that have a grill or a series of louvers that conceal the return air inlet opening but do not appreciably restrict the flow of return air through the inlet opening. The panels typically have two or more fastener holes in the panels that receive threaded fasteners used in attaching the panels to a wall or ceiling surface. The heads of the fasteners are visible in the panel's fastener holes and detract from the aesthetic appearance of the panels.

Air vent assemblies that cover air outlet openings of the HVAC system typically include some type of damper mechanism that can control the flow of air through the outlet opening. The damper mechanism is assembled into a base of the air vent assembly and can be operated to completely close the air outlet opening and to open the air outlet opening in varying degrees. The outlet air vent assembly also includes a faceplate that is attached to the base and conceals the damper mechanism and the air outlet opening from view, but does not appreciably obstruct the flow of air through the outlet opening. The faceplate includes a lattice that conceals the air outlet opening, and the lattice can be constructed as a series of louvers or can be given a more ornamental appearance.

The need for having two different types of faceplates to cover air outlet openings and air inlet openings of an HVAC system contributes to the overall cost of the system. Air return or air inlet vent assemblies are typically comprised of a base that connects the assembly to the air return opening of the HVAC system and also connects with an air return faceplate that is specifically adapted for the particular base. In a like manner, air outlet vent assemblies are typically comprised of a base that attaches to the outlet opening of the HVAC system and includes the damper mechanism that is attached in the base, and the air outlet faceplate that covers over the base with the base, damper mechanism and faceplate being a pre-assembled unit.

SUMMARY OF THE INVENTION

The modular air vent assembly of the present invention is specifically designed to reduce the cost of HVAC systems by providing a kit of component parts that are used in both securing an air inlet faceplate over an air return duct opening of an HVAC system and in securing an air outlet faceplate and damper mechanism over an air outlet duct opening of an HVAC system. The air vent assembly kit of the invention is comprised of a frame, a base, a damper mechanism, and a pair of faceplates with one faceplate being intended for use in covering an air return inlet opening and the other faceplate being intended for use in covering an air outlet opening. The frame is designed to be inserted and secured in both an air outlet opening and an air inlet opening. The base is designed to be received and securely held in the frame without requiring separate fasteners and to have either of the faceplates selectively connected to the base. The base is also designed to have the damper mechanism selectively connected to or assembled in the base where desired. Thus, the base can be assembled into a frame that has been attached to an air return opening without a damper mechanism in the base, or the base can be assembled into a frame that has been attached to an air outlet opening with the damper mechanism assembled in the base. With the base assembled in an air return opening, the desired faceplate of the two faceplates of the kit can be selectively connected to the base by connectors of the faceplate that are inserted into the base and connect the faceplate to the base without separate fasteners. In a like manner, with the base containing a damper mechanism assembled into an air outlet opening of an HVAC system, the desired faceplate of the two faceplates can be selectively connected to the base by inserting connectors of the faceplate into the base and thereby connecting the faceplate to the base without separate fasteners. In both situations a border of the face plate overlies the fasteners that secure the frame to the air duct opening and thereby give the installed air vent assembly a more aesthetic appearance with the fasteners hidden from view.

By providing a frame and base that can be used in air return openings and air outlet openings and by providing a set of faceplates that can be selectively connected to the same base whether they cover an air return opening or an air outlet opening, the modular air vent assembly kit of the present invention simplifies the assembly of the HVAC system and reduces the number of parts needed in assembling the HVAC system and thereby reduces the costs of its assembly.

BRIEF DESCRIPTION OF THE DRAWINGS

Further features of the invention are revealed in the following detailed description of the preferred embodiment of the invention and in the drawing figures wherein.

DETAILED DESCRIPTION OF THE INVENTION

Figure 1:
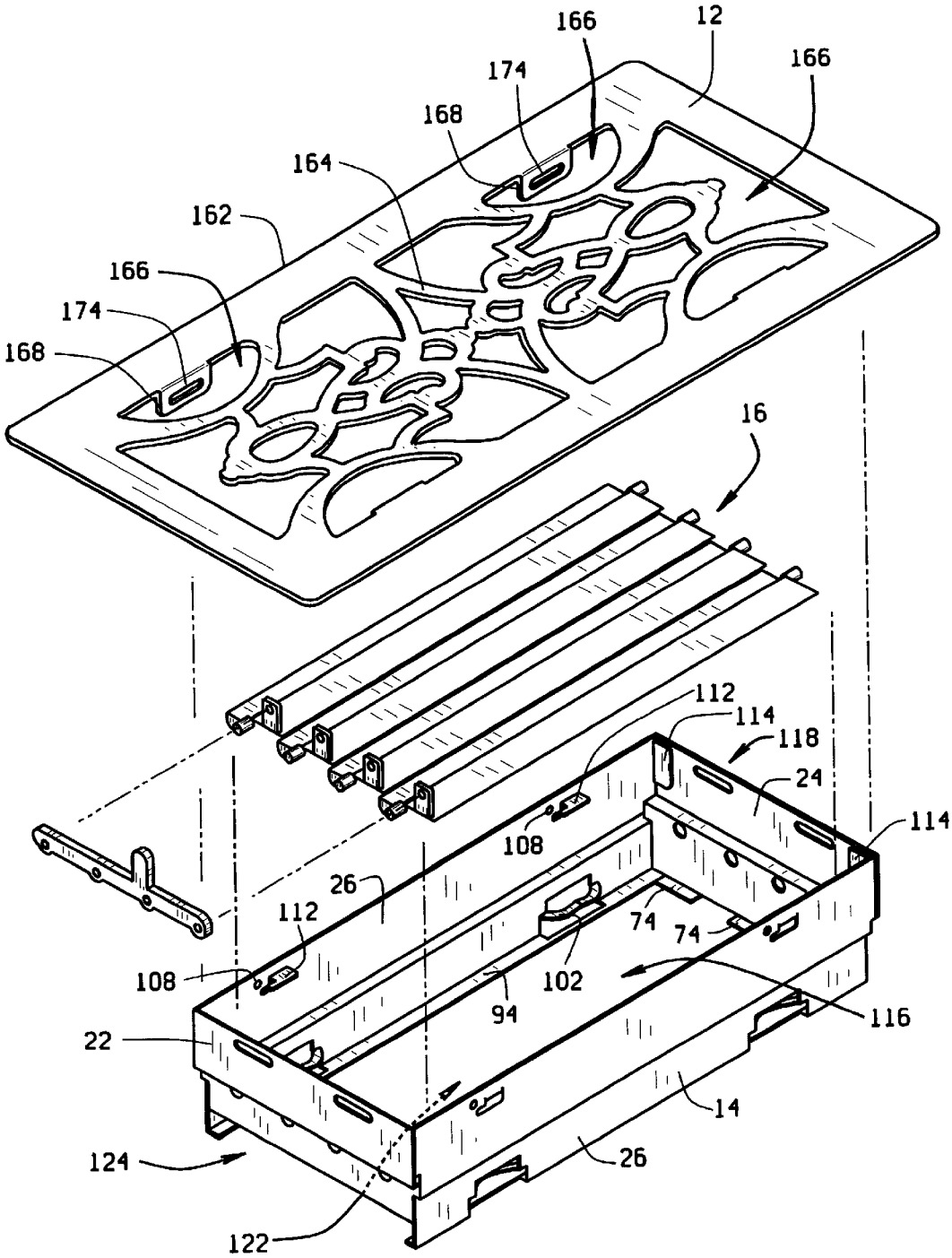
FIG. 1 is a perspective, exploded view of the air vent assembly kit of the invention.

The air vent assembly kit of the invention can be assembled in two different configurations, one of those two configurations being shown in FIG. 1. The air vent assembly configuration assembled from the kit shown in FIG. 1 includes a face plate 12, a base 14, and a damper mechanism 16. The other assembled configuration of the air vent assembly from the air vent assembly kit of the invention includes the same base 14 shown in FIG. 1 assembled to a different, second face plate 18 shown in FIG. 15. The second configuration of the air vent assembly assembled from the air vent assembly kit of the invention does not include the damper mechanism 16. In the preferred embodiment of the kit of the invention, both the first face plate 12 and second face plate 18, as well as the component parts that make up the base 14 and the damper mechanism 16 are all stamped from sheet metal making the air vent assembly kit of the invention inexpensive to manufacture. However, other materials such as plastics may be employed in constructing the component parts of the kit of the invention.

Figure 3:
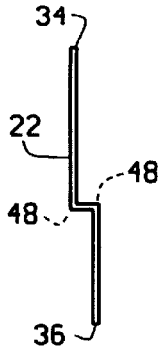
FIG. 3 is an end view of the base end wall of FIG. 2 following its forming.
Figure 2:
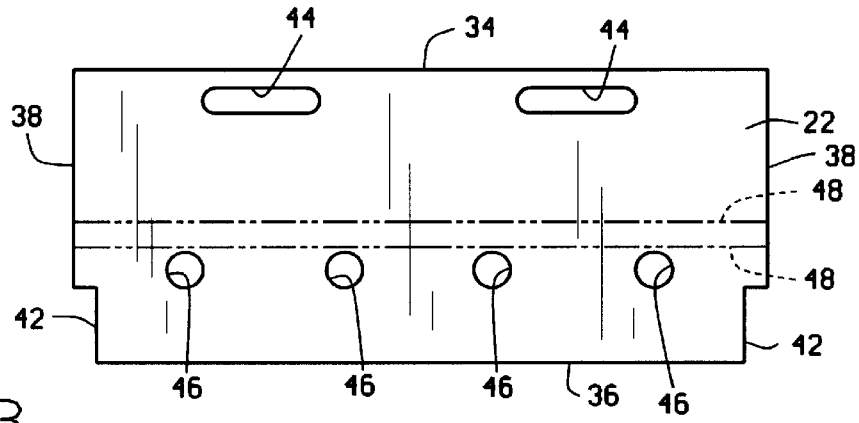
FIG. 2 is a side elevation view of an end wall of the base of the invention prior to forming.
Figure 5:
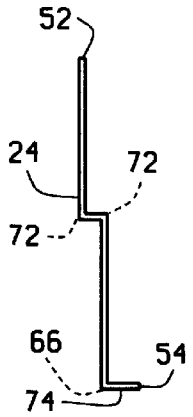
FIG. 5 is an end view of the end wall of FIG. 4 following its forming.
Figure 4:
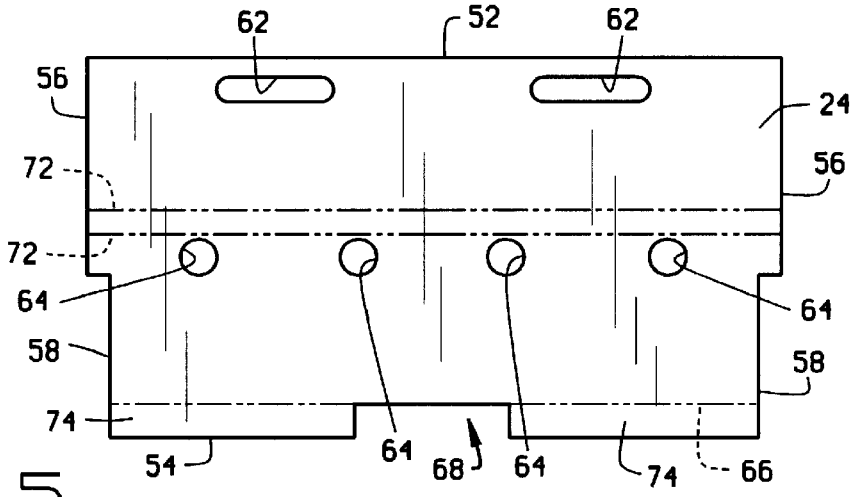
FIG. 4 is an elevation view of the second base end wall prior to its forming.
Figure 6:
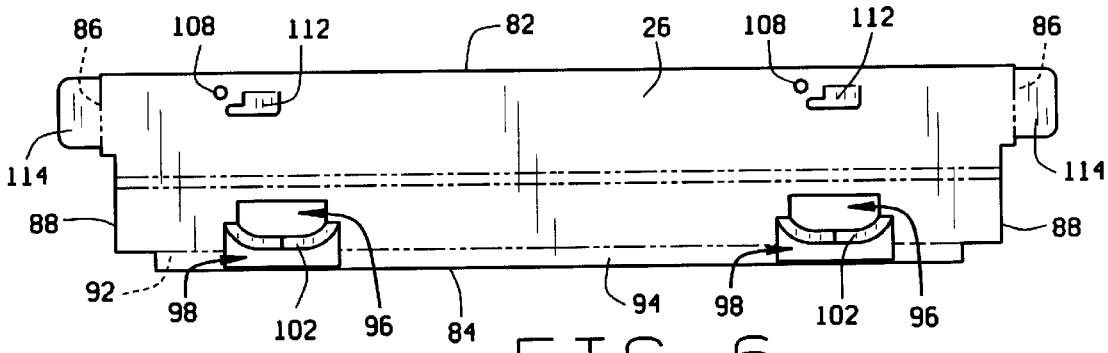
FIG. 6 is an elevation view of either of the side walls of the base prior to its forming.
Figure 7:
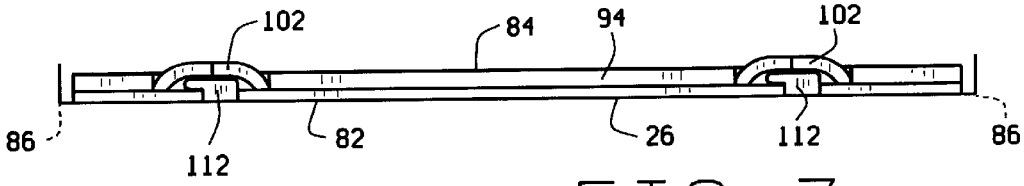
FIG. 7 is a top plan view of the side wall of FIG. 6 following its forming.
Figure 8:
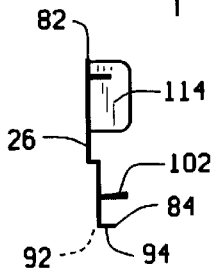
FIG. 8 is an end elevation view of the side wall of FIG. 6 following is forming.

The base 14 of the kit is constructed from a first base end wall 22 shown in FIGS. 2 and 3, a second base end wall 24 shown in FIG. 4 and 5 and a pair of identical base side walls 26 shown in FIGS. 6 and 7.

The two base end walls 22, 24 are not identical as the first base end wall 22 is slightly smaller than the second base end wall 24. FIG. 2 shows the first base end wall 22 as a flat, stamped piece of sheet metal. The end wall is formed with a top edge 34 and a parallel bottom edge 36, and opposite side edges with upper side edges 38 being spaced slightly farther apart than lower side edges 42. The first end wall is formed with a pair of oblong openings 44 adjacent is top edge 34 and with four smaller circular openings 46 that extend across the end wall adjacent its transition between the upper side edges 38 and the lower side edges 42. Just above the circular openings 46 the first end wall has two fold or bend lines 48. In the final construction of the first end wall 32 it is folded along the two bend lines 48 to the configuration shown in FIG. 3.

The second end wall 24 shown in FIG. 4, like the first end wall described above is a flat stamped piece of metal with a top edge 52 and an opposite bottom edge 54. However, the distance between the top edge 52 and bottom edge 54 of the second end wall is slightly larger than that of the first end wall. The second end wall is also formed with opposite side edges which include upper side edges 56 that are spaced farther apart than the bottom side edges 58. The second end wall also has oblong openings 62 adjacent its top edge 52 and four smaller circular openings 64 that extend across the end wall adjacent the transition between the upper side edges 56 and the lower side edges 58. The second end wall is also provided with a pair of fold or bend lines 66 that extend across the end wall. In addition, the bottom edge 54 of the second end wall has a notch 68 with a fold line 72 that extends across the bottom of the end wall from the notch. The notch 68 and the second fold lines 72 define a pair of flanges 74 that project outwardly from the second end wall 24 when the second end wall is bent along the bend lines 66, 72 to the configuration shown in FIG. 5.

The two base side walls 26 are the same and only one is shown in FIG. 6 and FIG. 7. In FIG. 6 the side wall is shown as a flat blank stamped from sheet metal including a top edge 82 and an opposite bottom edge 84 and opposite side edges that include upper side edges 86 and lower side edges 88. A fold or bend line 92 extends across the side wall adjacent the bottom edge 84 and defines a flange 94 that extends across the bottom of the side wall for almost its entire length. Pairs of two rectangular cut outs 96, 98 are made in the side wall adjacent but spaced from the bottom edge 84. An arcuate strip 102 of side wall material is left between the two rectangular cut outs 96, 98. Two more fold lines 104, 106 are formed in the side wall just above the pairs of rectangular cut outs 96, 98. Two circular indentations are made in the side wall that form circular projections 108 on the interior surface of the side wall. A pair of curved cut out lines are made in the side wall adjacent the pair of circular projections 108 that form tabs or projections 112 having a general L-shape. The upper side edges 86 of the side walls are spaced slightly farther apart than the lower side edges 88, and the upper side edges 86 are formed with flaps 114 that project from fold lines defined by the upper side edges 86.

In forming the side walls 26 of the base into their final configuration shown in FIG. 7, each of the bottom flanges 94, the arcuate strips 102, the L-shape tabs 112 and the side edge flaps 114 are bent in the same direction from the side wall as shown in FIG. 7. The side walls are also bent along the two intermediate fold lines 104, 106 in the manner shown in FIG. 7 to complete the construction of each side wall.

The first end wall 22 and the second end wall 24 are assembled to the pair of side walls 26 by spot welding or otherwise securing the pair of flaps 114 of each side wall 26 to the first 22 and second 24 end walls in the orientations shown in FIG. 1. With the assembled relative positions of the base end walls 22, 24 and the base side walls 26 shown in FIG. 1, the bottom flanges 94, the arcuate strips 102 and the L-shaped tabs 112 of each side wall project into the interior 116 of the base and the bottom flanges 74 of the second end wall 24 also project into the interior 116 of the base. The interior 116 of the base is accessible through a top opening 118 of the base as well as through a bottom opening 122 of the base. The dimensions. of the first end wall 22 leave an opening slot 124 adjacent its bottom edge 36 that enables the insertion of a filter element in a rectangular frame (not shown) through the slot 124 between the bottom flanges 94 and the arcuate strips 102 of the side walls as well as on to the bottom flanges 74 of the second end wall 24 which securely hold the filter frame in place.

Figure 10:
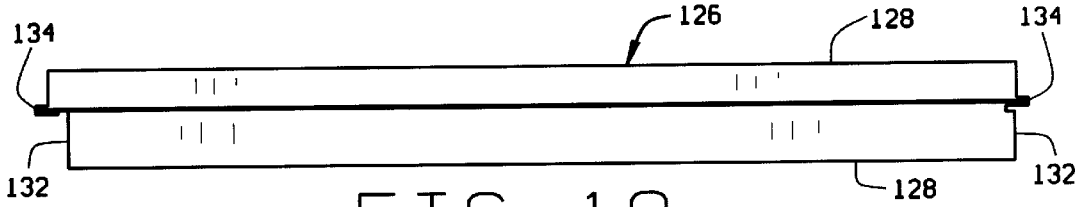
FIG. 10 is a plan view of the louver of FIG. 9 following its forming.
Figure 9:
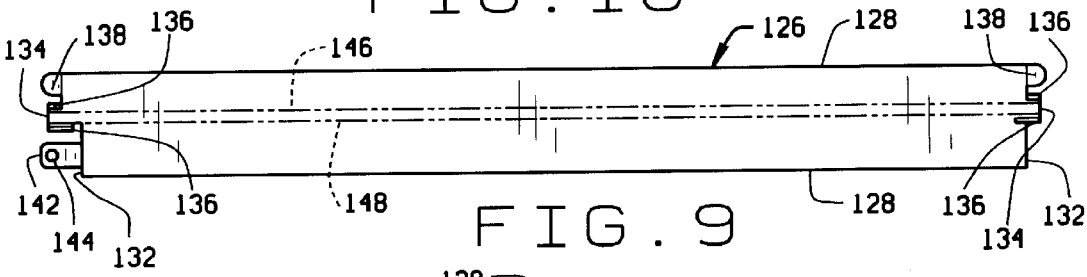
FIG. 9 is a plan view of a louver prior to its forming.
Figure 11:
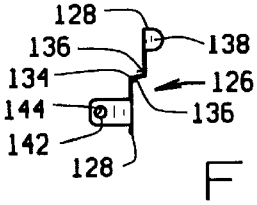
FIG. 11 is an end elevation view of the louver of FIG. 9 following its forming.

FIGS. 9 through 11 show the construction of a louver 126 of the damper mechanism 16 of the invention. FIG. 9 shows the louver 126 as a flat blank formed from sheet metal or plastic. The louver 126 has opposite, straight side edges 128 and opposite end edges 132. Each end edge 132 is formed with a projecting rectangular tab 134 with opposite side foldable margins 136 and a generally arcuate projecting tab 138. One of the end edges 132, the left side end edge as shown in FIG. 9, is also provided with a projecting flange 142 having a hole 144 passing therethrough. The louver is also provided with a pair of fold lines 146, 148 that extend across its length and separate the rectangular projecting tabs from their side edge margins 136. In forming the louver 126 into its final configuration shown in FIGS. 10 and 11, the louver is folded along the pair of fold lines 146, 148 in the manner shown in FIG. 11 and the side edge margins 136 of the pair of rectangular projecting tabs 134 are folded over on the tabs also as shown in FIG. 11. The opposite pair of arcuate projecting tabs 138 are bent at a right angle relative to the louver on one side of the louver and the louver flange 142 is bent at a right angle relative to the louver projecting from the opposite side of the louver relative to the arcuate tabs, as shown in FIG. 11. In the preferred embodiment of the invention, four damper mechanism louvers are formed in the same manner as the louver described above and as shown in FIGS. 9 through 11.

Figure 13:
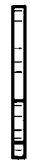
FIG. 13 is an end view of the louver actuator of FIG. 12.
Figure 12:
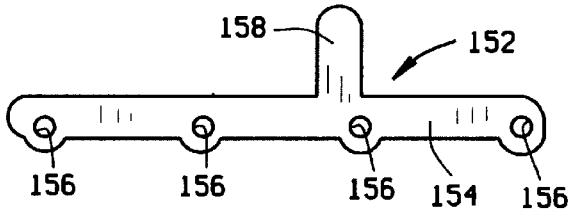
FIG. 12 is an elevation view of the louver actuator.

FIGS. 12 and 13 show the louver actuator that is assembled to the louvers 126 of the damper mechanism 16. The louver actuator is stamped from a flat sheet of metal in the configuration shown in FIG. 12 with an elongate bar 154 having a plurality of spaced openings 156 passing through the bar, and an actuator handle 158 projecting from the bar.

The louvers 126 and the louver actuator 152 of the damper mechanism 116 are assembled together and assembled into the interior 116 of the base in the manner shown in FIG. 1. Because the base end walls 22, 24 and each of the louvers 126 are constructed from flat sheets of metal, they are resiliently bendable. This enables each of the louvers 126 to be bent slightly to insert the projecting tabs 134 at the opposite ends of each louver into one of the circular openings 46, 64 of the first end wall 22 and the second end wall 24 of the base. Each of the louvers is assembled into the base in this manner with its flange 142 projecting toward the top opening of the base. The holes 156 of the louver actuator 152 are aligned with the louver flange holes 144 and the louver actuator is pivotally connected to each of the louver flanges 142 by a pin or other similar type of mechanical fastener inserted through the aligned holes. With the damper mechanism 16 thus assembled into the base 12, the actuator handle 158 can be moved between the opposite base side wall 26 to pivot the louvers between opened and closed positions in the base interior 116.

Figure 14:
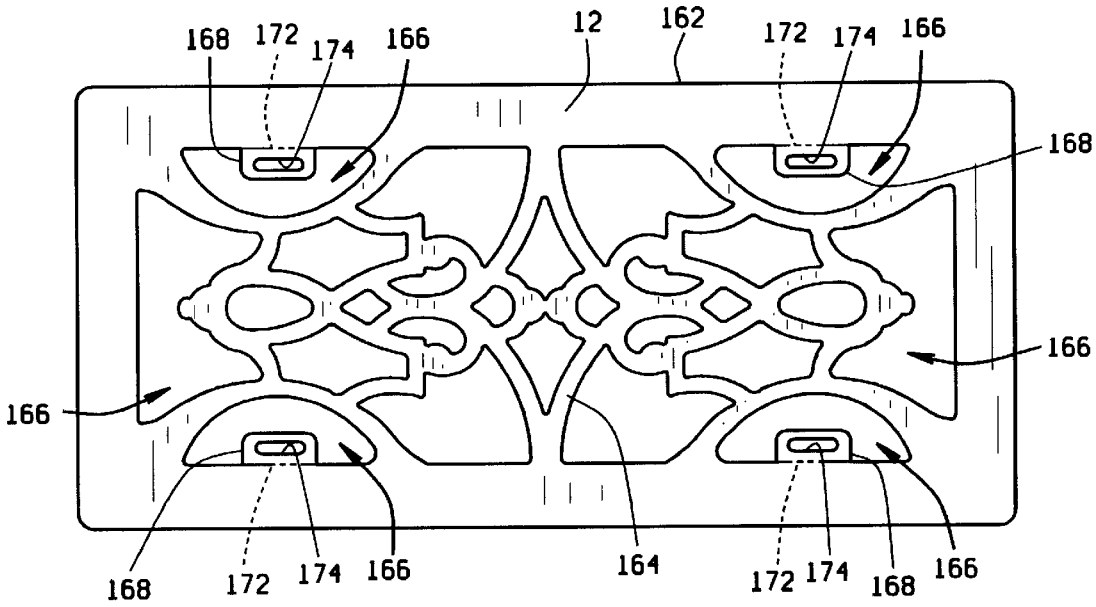
FIG. 14 is a plan view of the lattice face plate of the kit.

The first face plate 12 of the air vent assembly kit is shown in FIG. 14. Like the other component parts of the invention, the first face plate 12 is preferably stamped from a flat sheet of steel or made from wood or plastic with a rectangular border 162 and a decorative lattice 164 in the interior of the border. In the stamping of the first face plate 12, preferably the interior of the rectangular face plate surrounding the lattice 164 is flat and portions of the face plate around the border 162 angle slightly downward from the top surface of the face plate. The lattice 164 is defined by a plurality of openings 166 stamped in the face plate. The face plate border 162 is also formed with four rectangular projecting tabs 168 that extend inwardly from the border 162 into four of the lattice openings 166. The projections or tabs 168 are connected to the face plate border 162 by fold lines 172. Each of the tabs has an oblong opening 174 passing through the tab. In the final construction of the first face plate 12, each of the tabs or projections 168 is bent downwardly across its fold line 172 so that the tabs project perpendicularly below the face plate 12.

The first face plate 12 with its decorative lattice 164 is designed to be used in the air vent assembly of the invention when the base 14 is assembled with the damper mechanism 16 and is to be used in an air outlet opening of an HVAC system. Moving the damper mechanism 16 between its opened and closed positions controls the flow of air through the air outlet opening of the HVAC system into which the air vent assembly has been inserted. The first face plate 12 is assembled to the base 14 by first positioning it over the top opening 118 of the base with each of the four face plate tabs or projections 168 positioned over one of the L-shaped tabs or projections 112 of the base. Pressing the first face plate 12 downward on top of the base 14 will result in the face plate tabs or projections 168 resiliently flexing inwardly toward each other as they pass over the L-shaped tabs or projections 112 of the base. The first face plate 12 is pressed downwardly until the L-shape projections or tabs 112 of the base pass into the openings 174 of the face plate tabs 168. The first face plate 12 is then moved to the right as viewed in FIG. 1 until the circular projections 108 on the interior of the base side walls 26 are positioned at the sides of each of the face plate tabs 168 and securely hold the tabs against movement on the L-shaped projections 112 of the base. In this manner the first face plate 12 is attached to the base 14 without separate fasteners. The first face plate 12 can be easily removed from the base 14 by reversing the steps described above.

Figure 19:
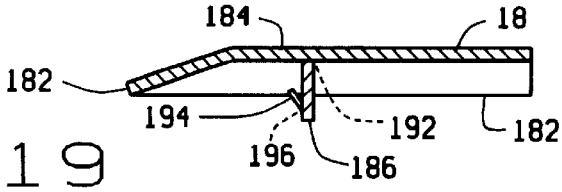
FIG. 19 is a partial section view of the louvered face plate of FIG. 15 from along the line 19—19.
Figure 15:
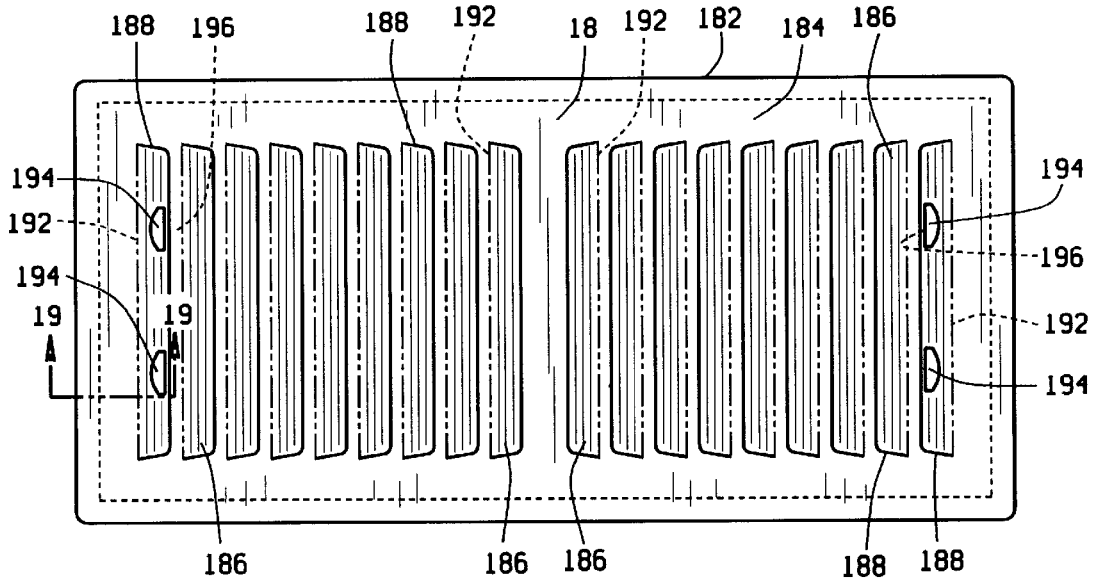
FIG. 15 is a plan view of the louvered face plate of the kit.
Figure 16:
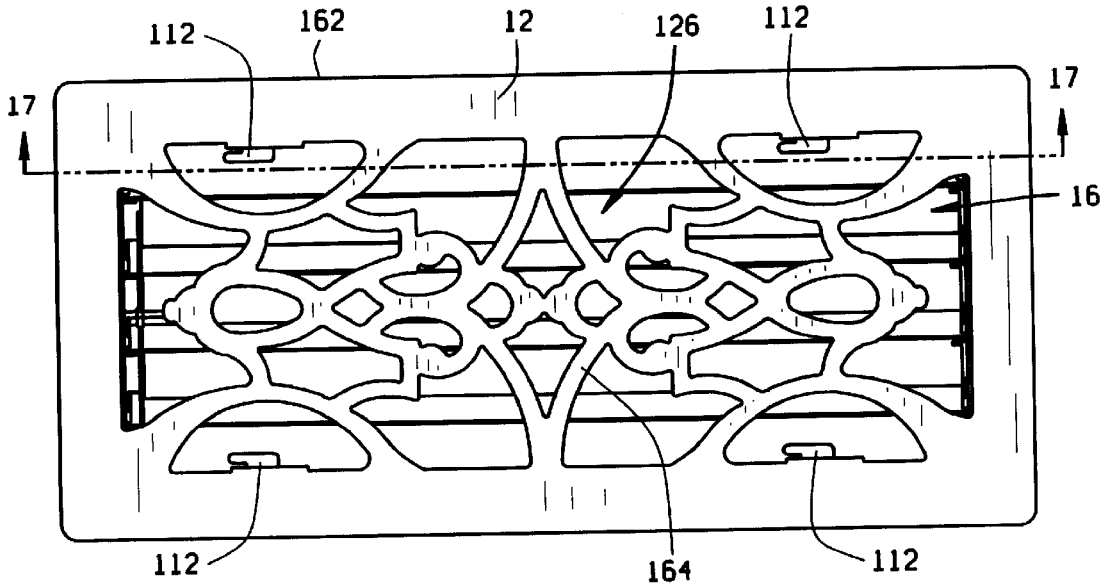
FIG. 16 is a plan view of the assembled air vent assembly kit with the lattice face plate.
Figure 17:
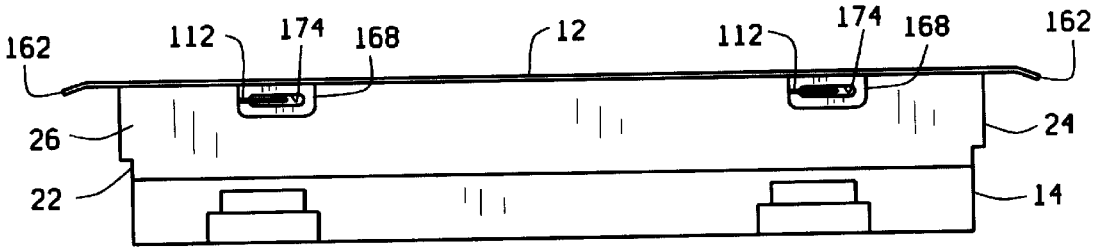
FIG. 17 is a side section view of the assembled air vent assembly kit of FIG. 16.
Figure 18:
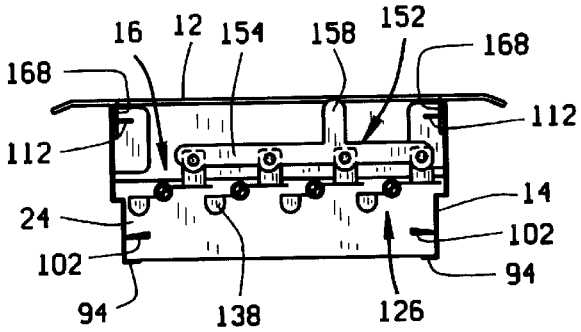
FIG. 18 is an end section view in section of the assembled air vent assembly kit of FIG. 17 along the line 18—18.

The second face plate 18 of the air vent assembly is shown in FIG. 15. The second face plate 18 is also stamped from a flat sheet of metal with a rectangular border 182 that is substantially the same size of the border as the first face plate 12. In addition, the second face plate border 182 is stamped so that it angles downwardly from the top surface of the second face plate in the same manner as the border of the first face plate. The interior area 184 of the second face plate is flat and has a plurality of louvers or vanes 186 formed by cuts having widened, generally U-shapes 188 made in the face plate. Fold lines 192 extend across each of the U-shaped cuts 188 and the louvers or vanes 186 are pressed downwardly below the top surface of the second face plate 18 across the fold lines 192. As seen in FIG. 15, each of the vanes or louvers 186 are formed in the second face plate 18 in two groups that project toward each other. An outer most pair of the vanes 186 have arcuate tabs 194 cut into the vanes. The tabs 194 are bent downwardly from their respective vanes 186 along fold lines 196. FIG. 19 shows the relative positions of the second face plate 18, one of the folded vanes 186 and the arcuate tab 194 folded outwardly from the vane.

The second face plate 18 is assembled to the base 14 in a similar manner to that of the first face plate 12 except that the damper mechanism 16 is not previously assembled into the base. The second face plate 18 is positioned over the base top opening 118 with the arcuate tab projections 194 positioned above the oblong openings 44, 62 in the respective first 22 and second 24 base end walls. The second base plate 18 is then pressed downwardly on the base top opening 118 causing the projecting arcuate tabs 194 to pass into the base interior 116 and engage in the oblong openings 44, 62 in the respective opposite base end walls 22, 24. In this manner, the second face plate 18 is attached to the base without separate fasteners. Because the second face plate 18 does not have the larger lattice openings 166 of the first face plate 12 that provide access to the louver actuator handle 158, the damper mechanism 16 is not used when the second face plate 18 is used in combination with the base 14. The second face plate 18 is intended to be used when the air vent assembly kit comprising the second face plate 18 and the base 14 are employed in covering an air return or air inlet opening of an HVAC system.

Figure 20:
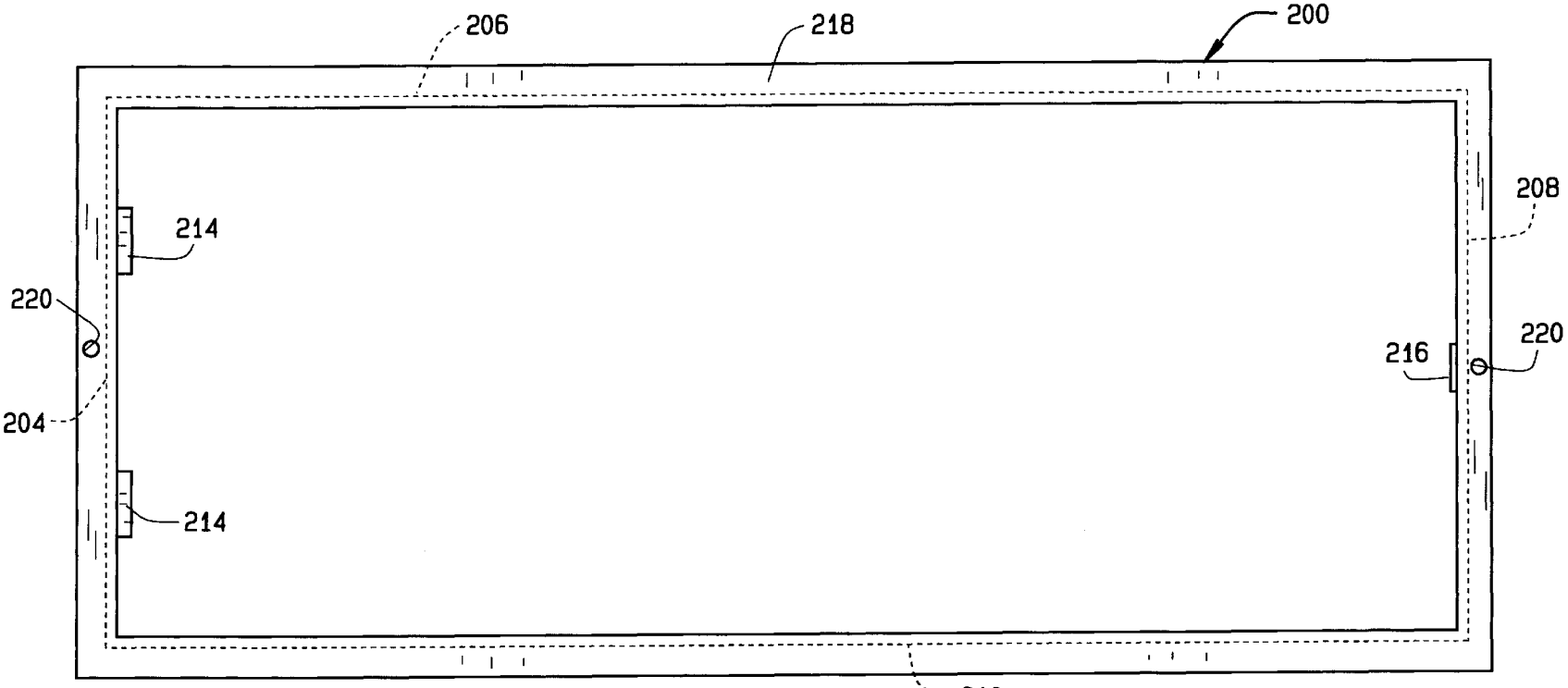
FIG. 20 is a top plan view of the frame of the invention.
Figure 21:
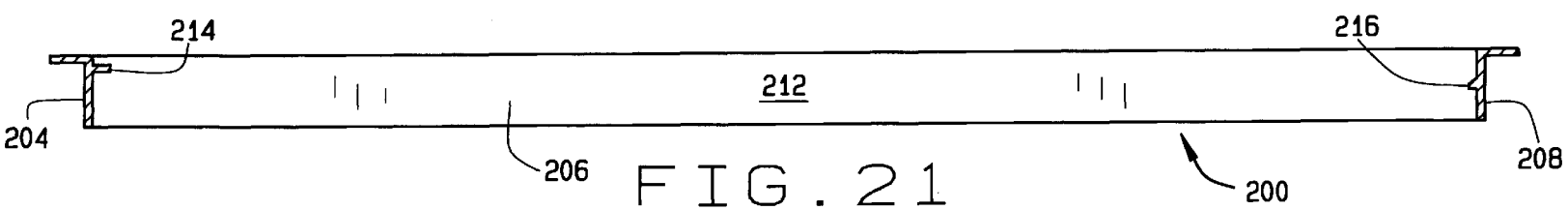
FIG. 21 is a side, sectioned view of the frame of FIG. 20.
Figure 22:
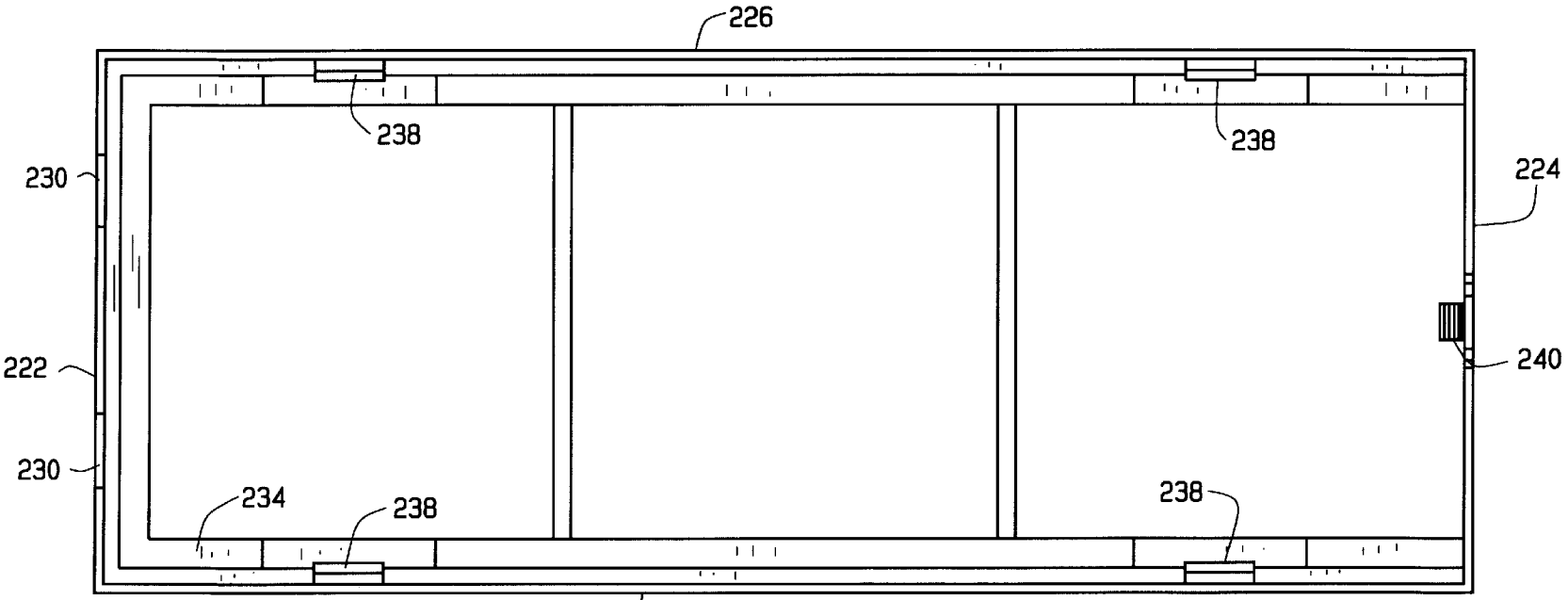
FIG. 22 is a top plan view of an alternate embodiment of the base.
Figure 23:
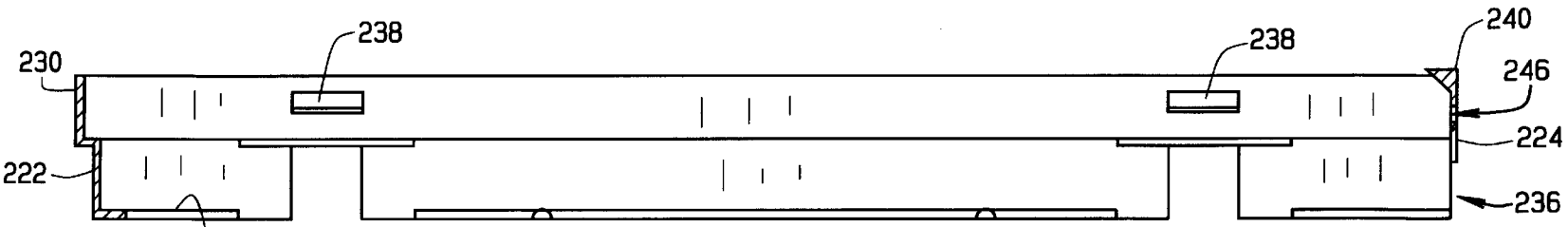
FIG. 23 is a side, sectioned view of the base shown in FIG. 22.
Figure 24:
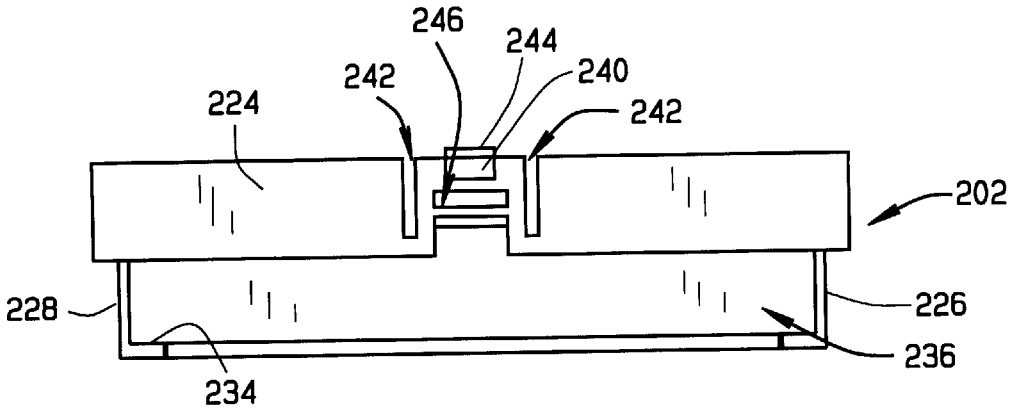
FIG. 24 is an end elevation view of one end of the base of FIG. 22.
Figure 25:
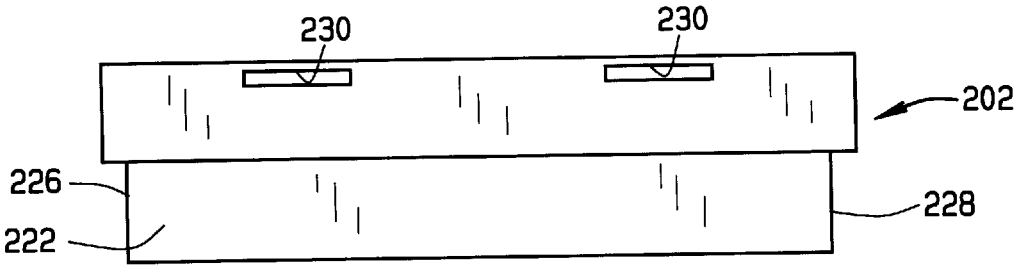
FIG. 25 is an end elevation view of the second end of the base of FIG. 22.
Figure 28:
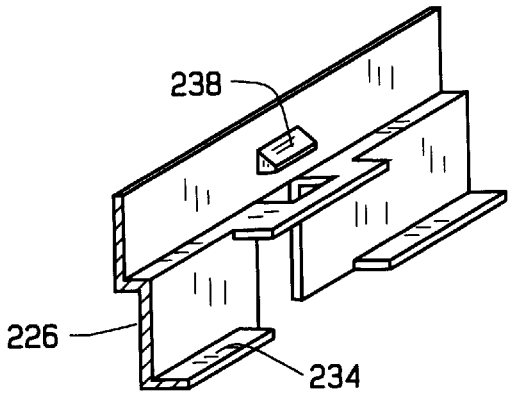
FIG. 28 is a partial perspective view of a portion of the base of FIG. 22.
Figure 26:
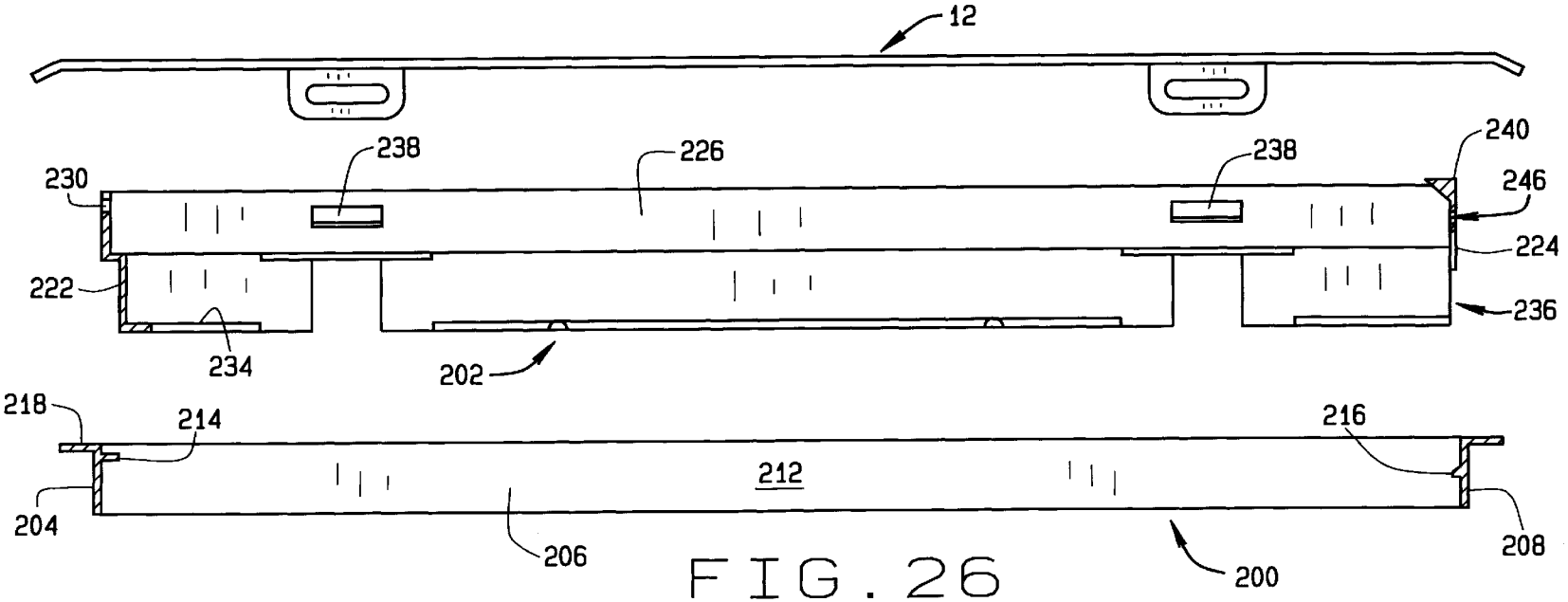
FIG. 26 is an exploded assembly view of the face plate of FIG. 14, the base of FIG. 22 and the frame of FIG. 20.
Figure 27:
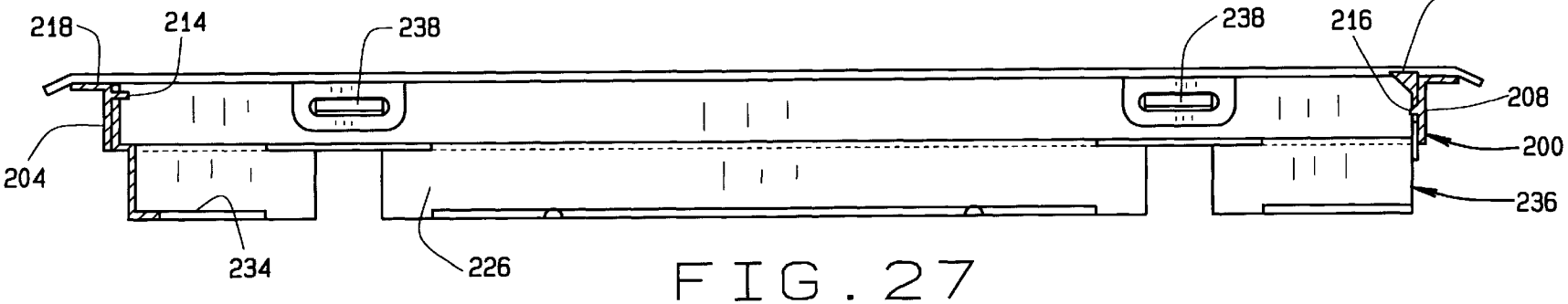
FIG. 27 is a sectioned, side view of the face plate, base and frame of 26 in their relative assembled positions.

FIGS. 20 and 21 show a frame 200 that is part of a further embodiment of the air vent assembly of the invention. FIGS. 22–25 show a modified base 202 that is similar to the base of the previously described embodiment and is employed with the frame 200 of the further embodiment of the invention. FIGS. 26 and 27 illustrate the manner in which the frame 200 and base 202 are assembled with a face plate of the first described embodiment of the invention. The additional embodiment of the invention to be described can be used with either of the face plates 12, 18 of the previously described embodiment and can also be used with the damper mechanism 16 of the previously described embodiment. Therefore, the constructions of the face plates and damper mechanism will not be described again. Although the first face plate 12 is shown in FIGS. 26 and 27 being assembled with the frame 200 and base 202 of the additional embodiment of the invention, it should be understood that both face plates 12, 18 are equally well suited for use with the additional embodiment. It is preferred that each of the component parts of the additional embodiment of the air vent assembly be constructed of plastic for its light weight which reduces shipping costs and its resiliency which enables the component parts to be assembled together without the use of separate fasteners as will be explained. However, the component parts of the additional embodiment of the invention may be constructed of other materials.

The frame 200 is constructed in a rectangular configuration defined by two opposite end walls 204, 208 and two opposite side walls 206, 210 of the frame. Each of the end walls and side walls is positioned parallel to each other and are interconnected giving the frame its rectangular box shape shown in FIG. 20. The end walls and side walls surround a hollow interior volume 212 of the frame. A pair of protrusions or abutments 214 project from one of the end walls 204 into the interior volume 212 of the frame and a single protrusion or abutment 216 protrudes from the opposite end wall 28 into the interior volume 212 of the frame. The protrusions are employed in releasably attaching the base 202 to the frame 200 in the frame interior 212 without separate fasteners as will be explained. The frame also includes a flange 218 that extends around the periphery of the frame end walls and side walls and projects outwardly from the end walls and side walls as seen in FIGS. 20 and 21. A pair of fastener holes 220 pass through portions of the flange 218 at opposite ends of the frame.

The base 202 has a similar rectangular configuration as the base 14 of the first described embodiment that is defined by the opposite end walls 222, 224 and side walls 226, 228 of the base. Like the first described embodiment of the base, the base 202 is provided with oblong holes 230 in one of its end walls, a shoulder surface 232 around its interior periphery for stacking or nesting purposes, and a bottom flange 234 with a slot 236 for receiving a filter assembly that is supported on the bottom flange 234 in the same manner as the first described embodiment. Opposing pairs of pawls 238 project inwardly from opposite side walls of the base for releasably attaching one of the face plates to the base. The base 202 differs from the base 14 of the first described embodiment in that it is provided with the pair of oblong holes 230 in only one of its end walls 222 with there being no corresponding oblong holes in the end wall 224 of the slot 236, and that it does not include damper mechanism holes. The base 202 shown in FIGS. 22–25 is designed for use without a damper mechanism. However, the base end walls 222, 224 could easily be modified with damper holes such as those 64 of the first described embodiment in order to adapt the base 202 for use with a damper mechanism. In addition, the end wall 222 above the slot 236 is provided with a resilient tab 240 that is formed by a pair of slots 242 that extend downwardly through the end wall 242 from its top edge. The resiliency of the material of the base gives the tab 240 its resiliency. The tab has a knurled surface 244 at its top to facilitate manual deflection of the tab, and an abutment formed by an opening 246 through the tab.

The assembly and use of this further embodiment of the air vent assembly is shown in FIGS. 26 and 27. In assembling the air vent assembly to an air duct opening, the frame 200 is first positioned with its end walls and side walls 204, 206, 208, 210 extending into a rectangular air duct opening and its flange 218 resting on a surface adjacent the periphery of the air duct opening. The frame 200 is then secured to the surface surrounding the air duct opening by inserting threaded fasteners, for example wood screws, through the flange fastener holes 220 and securing the fasteners down to securely hold the frame to the air duct opening.

The base 202 with an inserted filter (not shown) is next inserted into the interior volume 212 of the frame. The base 202 can be empty if a damper mechanism for the air duct opening is not required, or can be previously assembled with a damper mechanism in a similar manner to that of the first described embodiment. The base 202 is inserted into the frame interior volume 212 by first inserting the base end wall 222 with the pair of oblong holes 230 into the interior volume so that the pair of protrusions or abutments 214 of the one frame end wall 204 will engage in the oblong holes 240. The opposite base end wall 224 with the resilient tab 240 is then inserted into the frame interior volume 212 while manually deflecting the resilient tab inwardly by pushing on the knurled surface 244 of the tab. When the resilient tab abutment opening 246 is aligned with the single protrusion 216 of the frame the tab is released causing the protrusion 216 to engage in the abutment opening 246 of the tab and thereby securing the base to the interior 212 of the frame without the need for separate fasteners.

Next, one of the face plates 12, 14 is releasably secured to the base by pressing the face plate downwardly onto the base 208 so that the face plate projections or tabs 168 pass over the pawls 238 on the interior surface of the base. The face plate is pressed downwardly until the base pawls 238 engage in the openings 174 of the face plate tabs, thereby releasably securing the face plate to the base 202 and in turn to the frame 200. This also allows for easy, no tools required removal of the faceplate, damper and filter housing from the wall for easy cleaning or replacement of the filter.

In the manner described above, the additional embodiment of the air vent assembly is secured to an air duct opening without the need for separate fasteners.

Figure 29:
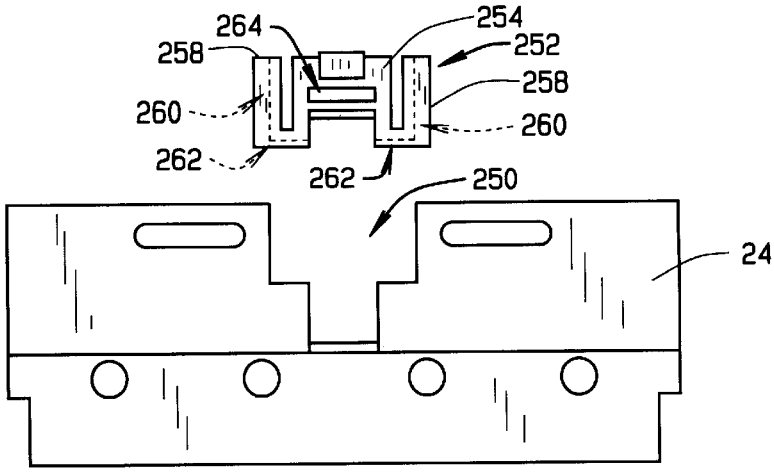
FIG. 29 is an end elevation view of the base of FIG. 1 that has been modified for use with the frame of FIG. 20 together with an insert used with the modified base.
Figure 31:
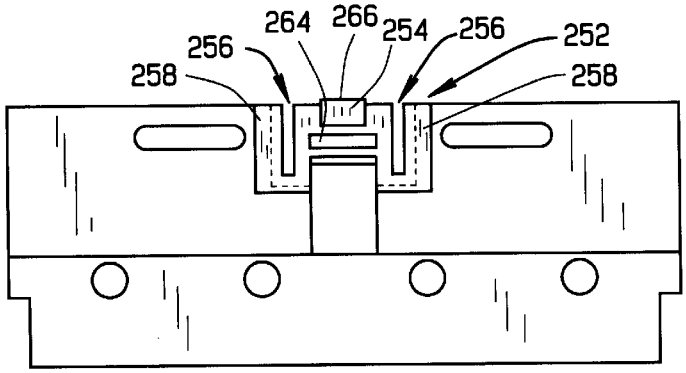
FIG. 31 is an end elevation view of the modified base of FIG. 29 with the insert received on the base.
Figure 30:
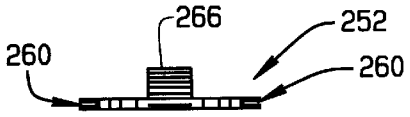
FIG. 30 is a top plan view of the insert employed with the modified base of FIG. 29.

FIGS. 29–31 show a modification to the base 14 of the first described embodiment that enables it to be used with the frame 200 of the last described embodiment. In one of the base end walls 24, a slot 250 is cut downwardly from the top edge of the end wall. A resilient tab assembly 252 constructed of plastic is inserted into the end wall slot 250. Like the resilient tab 240 of the last described embodiment, the tab assembly 252 has a tab 254 at its center with a pair of downwardly extending slots 256 at opposite sides of the tab 254. The slots 256 separate the tab from a pair of upwardly extending arms 258 positioned outside of the slots. The arms 258 have grooves 260 formed in their outer edges. The grooves 260 also include bottom groove portions 262 that extend below the arms 258, the slots 256 and portions of the tab 254. The grooves 260, 262 are dimensioned with widths that receive portions of the base end wall 24 in the grooves when positioning the resilient tab assembly 252 in the end wall slot 250 as shown in FIG. 31. The insertion of the resilient tab assembly 252 into the end wall slot 250 of the first described base 14 adapts this base for use with the frame 200. The tab 254 is provided with an abutment opening 262 and a knurled surface 266 just as the previously described tab. The modified base shown in FIGS. 29 and 31 is releasably assembled into the interior volume 212 of the frame 200 in the same manner as the last described embodiment of the invention. In addition, use of the modified base shown in FIGS. 29 and 31 enables a base containing a damper mechanism 16 to be releasably assembled into the frame 200 with one of the face plates 12, 14 being releasably attached to the base.

Figure 32:
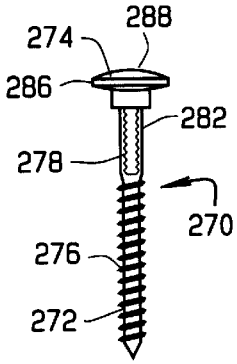
FIGS. 32 and 33 show a fastener assembly that may be used with either of the face plates of FIGS. 14 and 15 in securing the face plate to a surface while maintaining the aesthetic appearance of the face plate and eliminating the need for the frame shown in FIG. 20.
Figure 33:
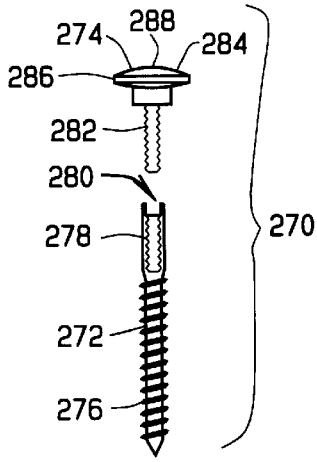

Should it be desired to simply attach one of the face plates 12, 14 over an air duct opening without the use either embodiments of the base or the frame, the fastener assembly 270 shown in FIGS. 32 and 33 may be employed to avoid the unsightly appearance of fastener heads on the exterior surface of the face plate. This also allows for easy, no tools required removal of the faceplate, damper and filter housing from the wall for easy cleaning or replacement of the filter. The face plates 12, 14 are modified by providing at least a pair of fastener holes at opposite ends of the face plate. The fastener assembly 270 is inserted into the fastener holes and is screwed down to attach the face plate to a surface surrounding the air duct opening.

The fastener assembly 270 is basically comprised of a shank portion 272 and a head portion 274. The shank portion 272 is constructed with external wood screw threads 276 at its bottom that extend along a substantial portion of the length of the shank portion. The top of the shank portion has internal machine screw threads 278 that extend downwardly through the interior of the shank portion. The very top of the shank portion is provided with a straight screwdriver slot 280, although a Phillips screwdriver slot could also be provided.

The head portion 274 of the fastener assembly has an external machine threaded shank 282 that mates with the internal machine threads of the shank portion. A screw head 284 is provided at the top of the external threaded shank 282. The head 284 is provided with a knurled edge 288 to facilitate manual turning of the head 284 and a rounded, smooth top surface 288.

In use of the fastener assembly 270 in attaching a face plate with fastener holes over an air duct opening, the face plate is first positioned over the air duct opening. One of the shank portions 272 of the fastener assembly is then screwed into the surface surrounding the air duct opening through each fastener hole of the face plate. A screwdriver is inserted into the slot 280 at the top of the shank portion 272 to assist in driving the shank portion into the material surrounding the air duct opening. When the slot 280 is substantially flush with the exterior surface of the face plate, the head portion 274 is then attached to the shank portion 272 by screw threading the external machine threaded shank 282 of each head portion into the internal machine screw threading 278 of the shank portion. The head portion 274 is tightened down on the shank portion 272 to thereby secure the face plate over the air duct opening. The smooth top surface 288 of the screw head 284 provides a more aesthetically pleasing appearance on the external surface of the face plate than would the head of a conventional wood screw.

Thus, the air vent assembly kit of the invention described above provides a base that can be assembled to either an air outlet opening or an air inlet opening of an HVAC system and interchangeable first and second face plates that can be attached to the base whether covering an air inlet opening or an air outlet opening of the HVAC system. The damper mechanism 16 of the kit can be selectively assembled to the base or left out of the base as desired. Furthermore, because the base end walls and side walls are constructed with lower sections that are spaced inwardly toward each other, a plurality of bases can be nested together and stacked in a compact arrangement for shipping or storage. The damper mechanism 16 and the face plates 12, 18 can also be packaged substantially flat for compact shipping or storing. Still further, by stamped each of the component parts from sheet metal the air vent assembly kit of the present invention is inexpensively manufactured.

While the present invention has been described by reference to specific embodiments, it should be understood that modifications and variations of the invention may be constructed without departing from the scope of the invention defined in the following claims.

What is claimed:

1. An air vent assembly comprising:

a frame that is dimensioned to be inserted into an air duct opening, the frame having an exterior surface and an opposite interior surface that surrounds an interior volume of the frame;

a base that is dimensioned to be inserted into the interior volume of the frame to be supported in the frame, the base having an exterior surface that opposes the frame interior surface when the base is inserted into the frame interior volume and the base having an opposite interior surface that surrounds an interior volume of the base;

a face plate that is attachable to the base to cover over the base interior volume; and the face plate is attachable to the base without requiring separate fasteners and the base is attachable to the frame without requiring separate fasteners.

2. The air vent assembly of claim 1, wherein:

the face place has a plurality of projections that are positioned on the face plate where they will oppose the base interior surface when the face plate is attached to the base.

3. The air vent assembly of claim 1, wherein:

one of the frame interior surface and the base exterior surface are provided with openings and the other of the frame interior surface and the base exterior surface are provided with projections that extend into the openings when the base is inserted into the frame thereby attaching the base to the frame.

4. The air vent assembly of claim wherein:

one of the face plate and the base interior surface are provided with openings and the other of the face plate and base interior surface are provided with projections that extend into the openings when the face plate is attached to the base.

5. The air vent assembly of claim 1, wherein:

the frame has a side wall that extends around the interior volume of the frame with the frame exterior surface and interior surface being on opposites sides of the side wall, and the frame has a flange that projects from the frame side wall and is adapted to receive a fastener to secure the frame to a surface adjacent an air duct when the frame is inserted into the air duct.

6. The air vent assembly of claim 5, wherein:

the face plate has a border that is positioned to overlie the frame flange obstructing the flange from view when the base is inserted into the frame and the face plate is attached to the base.

7. The air vent assembly of claim 5, wherein:

the flange is one of a pair of flanges that project away from each other at opposite ends of the frame and the face plate border overlies the frame flanges obstructing them from view when the base is inserted into the frame and the face plate is attached to the base.

8. The air vent assembly of claim 5, wherein:

the base is received entirely within the frame side wall.

9. An air vent assembly comprising:

a frame that is dimensioned to be inserted into an air duct opening, the frame having an exterior surface and an opposite interior surface that surrounds and interior volume of the frame;

a base that is dimensioned to be inserted into the interior volume of the frame to be supported in the frame, the base having an exterior surface that opposes the frame interior surface when the base is inserted into the frame interior volume and the base having an opposite interior surface that surrounds an interior volume of the base;

a face plate that is attachable to the base to cover over the base interior volume; and the frame has a side wall that extends around the interior volume of the frame with the frame exterior surface and the frame interior surface being on opposites sides of the side wall;

the base has a side wall that extends around the interior volume of the base with the base exterior surface and the base interior surface being on opposite sides of the base side wall;

a resilient tab projects from the side wall of one of the frame and base and an abutment is provided on the side wall of the other of the frame and base where the abutment will engage with the tab when the base is inserted into the interior volume of the frame to sucurely hold the base in the frame and where the resilient tab may be deflected to disengage the abutment from the tab and enable removal of the base from the frame interior volume.

10. The air vent assembly of claim 9, wherein:

the face plate has an exterior surface and the tab projects to a position where the tab is flush with and accessible through the face plate exterior surface when the base is inserted into the frame and the face plate is attached to the base.

11. The air vent assembly of claim 1, wherein:

the frame has a side wall that extends around the interior volume of the frame with the frame exterior surface and the frame interior surface on opposite sides of the side wall;

the base has a side wall that extends around the interior volume of the base with the base exterior surface and the base interior surface on opposite sides of the side wall;

one of the frame interior surface and the base exterior surface are provided with openings and the other of the frame interior surface and the base exterior surface are provided with projections that extend into the openings when the base is inserted into the frame thereby attaching the base to the frame.

12. The air vent assembly of claim 1, wherein:

an air filter is removably secured in the base interior volume.

13. The air vent assembly of claim 12, wherein:

a damper mechanism is secured in the base interior volume for movement of the damper mechanism between opened and closed positions.

14. An air vent assembly comprising:

a frame that is dimensioned to be inserted into an air duct opening, the frame having an interior volume and a side wall that surrounds the interior volume, the side wall having opposite exterior and interior surfaces, and the frame having a flange that projects from the frame side wall away from the frame interior volume, the flange having means for receiving a fastener to secure the flange and the frame to a surface adjacent an air duct opening when the frame is inserted into the air duct opening; and a face plate that is removably attachable to the frame to cover over the interior volume of the frame, the face plate having a border that is positioned on the face plate to overlie the frame flange and obstruct the frame flange from view when the face plate is attached to the frame.

15. The air vent assembly of claim 14, wherein:

the flange is one of a pair of flanges at opposite ends of the frame and the face plate border overlies the pair of flanges obstructing the pair of flanges from view when the face plate is attached to the frame.

16. The air vent assembly of claim 15, wherein:

the face plate has a plurality of openings that are positioned within the face plate border and to overlie the frame interior volume when the face plate is attached to the frame.

17. The air vent assembly of claim 16, further comprising:

a base that is dimensioned to be inserted into the interior volume of the frame, the base having an interior volume and a side wall that surrounds the interior volume, the side wall having opposite exterior and interior surfaces with the base side wall interior surface surrounding the base interior volume and the base side wall exterior surface opposing the frame interior surface when the base is inserted into the frame interior volume.

18. The air vent assembly of claim 17, wherein:

one of frame interior surface and the base exterior surface are provided with openings and the other of the frame interior surface and the base exterior surface are provided with projections that extend into the openings when the base is inserted into the frame thereby attaching the base to the frame.

19. The air vent assembly of claim 18, wherein:

one of the face plate and the base interior surface are provided with openings and the other of the face plate and base interior surface are provided with projections that extend into the openings when the face plate is attached to the base.

* * * * *